United States Patent [19]

von Besser

[11] 4,023,824

[45] May 17, 1977

[54] SKI BINDING APPARATUS

[76] Inventor: Kurt von von Besser, 218 S. Hoyne Ave., Chicago, Ill. 60612

[22] Filed: Feb. 10, 1975

[21] Appl. No.: 548,679

Related U.S. Application Data

[63] Continuation-in-part of Ser. No. 263,295, June 15, 1972, Pat. No. 3,874,685, and a continuation-in-part of Ser. No. 338,595, March 6, 1973, Pat. No. 3,876,218.

[52] U.S. Cl. ..... 280/618; 280/623; 280/636

[51] Int. Cl.[2] ..... A63C 9/08

[58] Field of Search ..... 280/11.35 K, 11.35 T, 280/618, 617, 620, 623, 633, 636

[56] References Cited

UNITED STATES PATENTS

| | | | |
|---|---|---|---|
| 2,745,672 | 5/1956 | Meier, Jr. | 280/11.35 T |
| 2,788,981 | 4/1957 | Emerson | 280/623 |
| 2,793,869 | 5/1957 | Braun | 280/623 |
| 3,199,885 | 8/1965 | Smolka et al. | 280/11.35 T |
| 3,241,849 | 3/1966 | Bodycomb | 280/11.35 T |
| 3,410,568 | 11/1968 | Wiley | 280/11.35 K |
| 3,489,424 | 1/1970 | Gertsch et al. | 280/11.35 K |
| 3,672,694 | 6/1972 | Whittaker | 280/11.35 K |
| 3,727,932 | 4/1973 | Druss et al. | 280/11.35 K |
| 3,869,136 | 3/1975 | Jackson | 280/11.35 K |
| 3,874,685 | 4/1975 | von Besser | 280/618 |
| 3,876,218 | 4/1975 | von Besser | 280/618 |
| 3,936,064 | 2/1976 | D'Alessio et al. | 280/618 |

*Primary Examiner*—Joseph F. Peters, Jr.
*Assistant Examiner*—Milton L. Smith
*Attorney, Agent, or Firm*—Wegner, Stellman, McCord, Wiles & Wood

[57] ABSTRACT

A toe unit spring biases a release pin into mating engagement with an arcuate socket on a sole plate which is releasably securable to a ski boot. For increased anti-shock retention, the arcuate socket has inclined side walls with a lateral extent greater than two times the vertical extent of an inclined bottom wall, and greater than two times the diameter of a hemispherical end of the release pin. The sole plate has a pivot bar located under the ball of the skier's foot, and a rear beveled tongue which is urged into one of plural angled recesses in a rear retainer plate. The retainer plate can be rotated to change the ratio of upward to lateral release pressure. To provide cant adjustment, cant strips having snap-fit connectors are insertable into apertures in the sole plate.

16 Claims, 9 Drawing Figures

5.

30
128
62
60
166
6.
160
40
170
22
46
44
126
42
6.
124
164
32
122
144
58
170
172
26
120
59
52

5.

130
128
62
30
142
140
148
140
60
144
86
32
206
26

152
60
50
140
42
30
22
142
54
122
140
56
120
62
152
206
50

206
50
32
152
60
162
42
30
22
142
140
148
50
62

SKI BINDING APPARATUS

CROSS-REFERENCE TO RELATED APPLICATIONS

This application is a continuation-in-part of my copending application Ser. No. 263,295, filed June 15, 1972, entitled "Ski Binding Apparatus and Method of Mounting", now U.S. Pat. No. 3,874,685, issued Apr. 1, 1975, and a continuation-in-part of my copending application Ser. No. 338,595, filed Mar. 6, 1973, entitled "Ski Binding apparatus", now U.S. Pat. No. 3,876,218, issued Apr. 8, 1975.

BACKGROUND OF THE INVENTION

This invention relates to a ski binding having improved anti-shock and release characteristics.

In prior sole plate ski bindings, an arcuate socket has been located on an upright ear of the sole plate for mating engagement with a segmental spherical end of a release pin restrained to move in an axial direction. In response to an excessive force, the sole plate moves relative to a toe unit, and the inclined walls forming the arcuate socket cause the release pin to axially retract until the release pin rides over the rim of the concave socket to thereby release the sole plate.

A typical arcuate socket for such a sole plate ski binding has had inclined side walls with a lateral extent which is about 1.5 times the vertical extent of the inclined bottom wall. The overall width of the arcuate socket has been on the order of 1.3 times the diameter of the segmental spherical end of the release pin. While such a ski binding is a substantial improvement over other types of ski bindings, the amount of anti-shock travel has not been comparable with that produced by some nonsole plate ski bindings.

In such prior sole plate ski bindings, the pivot points typically have been near the arcuate socket end of the sole plate, and near the opposite tongue end of the sole plate. It is known that the forces which are exerted on a skier's foot are in-line with the ball of the foot, as well as in-line with the heel portion and alignment of the pivot points with the locations of stress on the skier's foot would be desirable. However, this has not been possible in a sole plate ski binding without creating an undue amount of wobble when the sole plate is secured to the ski by means of the pin and the retainer plate.

SUMMARY OF THE INVENTION

In accordance with the present invention, the problems noted above with respect to prior ski bindings have been overcome. A sole plate ski binding carries an arcuate socket with an improved shape and dimension and which coacts with an axialy restrained release pin to greatly increase the anti-shock characteristics. The entire anti-shock travel region is traversed while maintaining controlled contact between the sole plate and the ski, allowing maximum edge control. When the anti-shock travel causes the sole plate to reach an unstable region, the sole plate is released in order to prevent injury. The sole plate has an anti-friction bar located under the ball of the foot. Due to the location of the pivot point relative to the other structure of the binding, a controlled contact with the ski is maintained for improved safety, while preventing wobble in the sole plate.

The ski binding can be readily modified even after mountin to provide cant or forward lean compensation.

Furthermore, the concave socket can be replaced by a different concave socket having a different lateral-to-vertical ratio so as to change the anti-shock characteristics of the ski binding.

One object of this invention is the provision of an improved ski binding with an arcuate release socket having inclined walls with relative dimensions with respect to each other and with respect to the release pin for improving the anti-shock characteristics of the binding.

Another object of this invention is the provision of an improved sole plate ski binding having a pivot bar located under the ball of the skier's foot, which provides dimensional stability to prevent wobble and premature release.

Other objects and features of the invention will be apparent from the following description and from the drawings. While illustrative embodiments of the invention are shown in the drawings and will be described in detail herein, the invention is susceptible of embodiment in many different forms and it should be understood that the present disclosure is to be considered as an exemplification of the principles of the invention and is not intended to limit the invention to the embodiments illustrated.

GENERAL DESCRIPTION OF THE SKI BINDING

Figures 1, 2, 3:
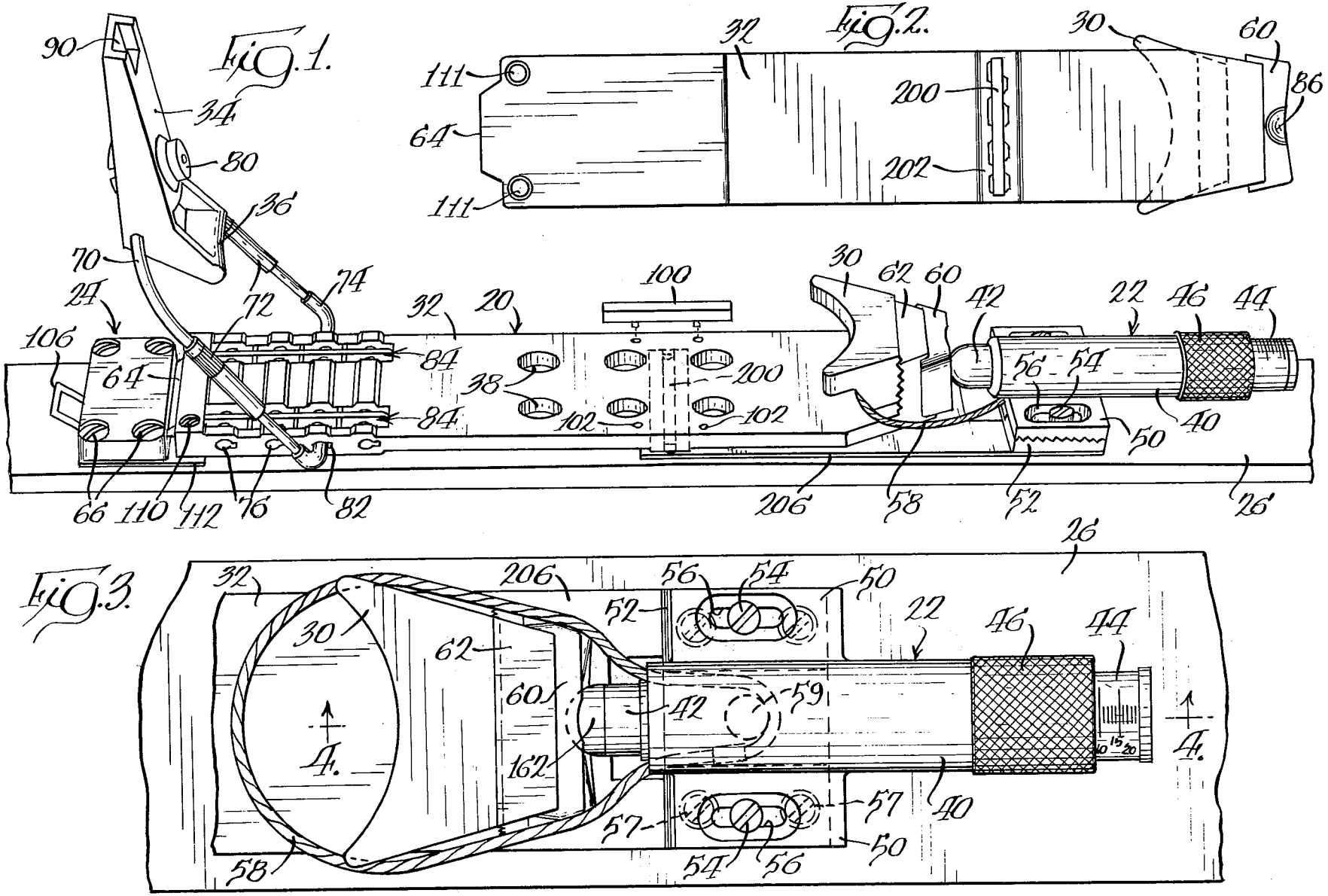
FIG. 1 is a perspective view of a sole plate ski binding which incorporates the present invention.
FIG. 2 is a bottom plan view, of reduced scale, of the sole plate shown in FIG. 1.
FIG. 3 is a top plan view, of increased scale, of the toe portion of the binding shown in FIG. 1.

In FIG. 1, a ski binding is illustrated which includes a sole plate unit 20 which is releasably secured to a toe release unit 22 and to a heel retainer unit 24, each of which are mounted to a ski 26. Sole plate unit 20 includes a toe ear bracket 30 which is adjustable in height, and is set for the thickness of the extending toe portion of a ski boot sole. The ski boot sole is releasably secured to the sole plate 32 by secondary release means, as a heel lever 34 having a clamp end 36 which bears against the extending heel portion of the ski boot sole to clamp it firmly against the sole plate 32. To lighten the weight of the sole plate 32 without changing its torsional stability nor its ability to resist bending, a number of cylindrical apertures 38 may be formed through the sole plate 32.

Toe release unit 22 forms the primary biased release means and includes a tubular housing 40 containing a spring biased, axially movable release pin 42. The pressure of the internal spring mechanism against the release pin 42 is varied by movement of an adjustment screw 44 which controls the compressed length of the internal spring, as will appear. A lock sleeve 46 surrounds the screw 44 and is rotatable into engagement with the tubular housing 40 to prevent inadvertent rotation of the adjustment screw 44 after a desired release setting has been selected.

Figure 4:
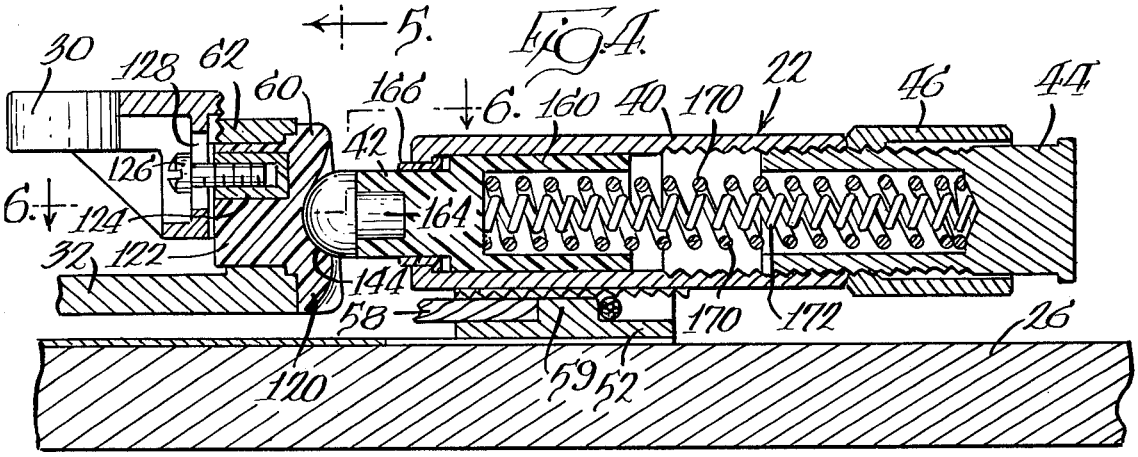
FIG. 4 is a sectional view of the toe release unit and the socket portion of the sole plate, taken along lines 4—4 of FIG. 3.

The tubular housing 40 has a pair of extending flanges 50 which detachably mount the upper spring biased release pin assembly to a lower base plate 52 which is fixedly secured by recessed screws 57 (see FIG. 3) to the ski 26. The base or lower plate 52 has a ribbed, toothed or serrated upper surface which meshes with a corresponding lower surface of flange 50. Each flange 50 is retained in engagement with the lower plate 52 by an extending lock screw 54 which passes through an elongated slot 56 in the flange 50 and into engagement with an internally threaded bore within the lower plate 52. The lock screws 54 may be rotated to release the upper spring biased assembly for movement parallel with the ski to different detented positions. A front safety cable 58 is looped around a cylindrical nub 59 (see FIGS. 3 and 4) extending upward from plate 52 to retain the sole plate unit 20 to the toe release unit 22, and hence to the ski 26, during a release.

Release pin 42 mates with a release socket 60, to be explained in detail, mounted within an integral upstanding ear 62 of the sole plate 32. To properly operate the binding, the upper housing is moved so that the release pin 42 firmly engages the arcuate socket 60. The release socket 60 has a concave contour which controls the upward and lateral pressure necessary to retract the axially restrained pin 42 sufficiently into housing 40 to release the sole plate unit 20 for retention on the ski 26. The spring biased pressure on the release pin 42 against the socket 60 urges the sole plate unit 20 rearwardly and thus urges a beveled rear tongue 64 into engagement with one of the inclined recesses within heel retainer plate 24. The heel plate 24 is mounted to a ski 26 by a plurality of screws 66 located in countersunk bores.

Heel lever 34 rotatably grips a cable 70 which terminates in a pair of cylindrical fine adjustment sleeves 72 each having an internal thread which engages a screw head attached to an arm 74 movable between a plurality of gross adjustment cylindrical holes 76 formed in the sole plate 32. To longitudinally position the heel lever 34 for a particular length ski boot, the ski boot is placed on the sole plate 32 with the toe of the boot under the toe ear bracket 30. The arms 74 are moved between the holes 76 to provide a gross adjustment which places the clamp end 36 immediately adjacent or touching the heel extension of the ski boot's sole. Further or fine longitudinal adjustment is done by rotating the sleeves 72, so that when heel lever 34 is raised, it locks or clamps the rear of the boot securely to the sole plate 32. An adjustment screw 80 controls the distance that lever 34 is offset from the rear of the ski boot. The arms 74 are retained within holes 76 by a transverse pin which prevents the arms from being withdrawn from the sole plate when the heel lever 34 is located in the locking position. The arms 75 may be rotated so as to position the transverse pin adjacent a keyslot 82 in the holes 76 to allow access to channel slots 84 formed on opposite sides of the sole plate 32.

During skiing, an excessive force on the ski binding will cause the sole plate unit 20 to be released at the socket 60 and/or at the heel retainer unit 24. The sole plate unit 20, however, remains attached to the ski boot. To reinsert the sole plate unit after a release, the beveled tongue 64 is placed in the recess at the rear heel retainer 24, and a centrally located indent 86 (see FIGS. 2 and 5) on the bottom of socket 60 is placed vertically over the release pin 42. Thereafter the skier exerts downward and forward pressure to cause the release pin 42 to retract into the housing 40 and then snap outwardly into the concave socket. To step out of the entire binding after skiing, the skier places the tip of his ski pole in a recess 90 in the heel lever 34, and exerts downward and outward pressure to disengage the clamp end 36 from the heel extension of the ski boot sole. The skier can now step out of the ski binding, leaving the sole plate unit 20 retained between the toe and heel units.

SPECIAL ADJUSTMENTS

To provide cant compensation, a front cant strip 100 may be snap-fitted into one set of two sets of apertures 102 in sole plate 32, each set being adjacent a different side of the sole plate. Apertures 102 preferably do not extend through the entire sole plate (as can be seen in FIG. 2), but rather extend for a distance of half or so of the thickness of the sole plate. This construction prevents snow on the ski from packing into the apertures 102. A rear cant strip (not illustrated) may be snap-fitted into one of the channels 84 which are longitudinally aligned with the front apertures 102. The heights of the front and rear cant strips are selected to cause the ski boot to have a slant or skew with respect to the planar top surface of the sole plate 32, which planar top surface is coplanar with the top of the ski 26. To properly clamp the extending toe of the ski boot, the sole engaging surface of the toe bracket 30 may be coplanar with the skew plane produced by the cant strips. Alternatively, a standard toe bracket 30 (i.e., the toe engaging surface of the toe bracket is parallel with the planar surface of the sole plate) may be utilized by inserting an adaptor plate or member (not illustrated) between the spaced ribs on the toe bracket 30 and the spaced ribs on the upright ear 62. The adaptor member may have ribs located at a cant corresponding to the cant of the cant strips, or may have a compressible surface (such as a neoprene cushion) which allows tilting of the toe brackets 30.

To change the degree of cant or cant angle, the cant strips may be removed and replaced with cant strips of a different height. The heel lever 34 may be canted to correspond with the cant angle by appropriate rotation of the adjustment sleeves 72 to shorten or lengthen the effective length of the cables which attach the heel lever to the sole plate. Forward lean compensation can be provided by a skew strip (not illustrated) which is attached across the channels 84.

To change the ratio of upward to lateral release pressure, the heel retainer plate 24 may include a plurality of recesses, located on opposite sides of the plate. A safety ring 106 is captured by a central nub, located in an open channel between the recesses, to provide a mounting holder for a rear safety strap. If desired, the skier may use both the front safety cable 58 and a rear safety strap affixed to ring 106 in order to provide two point fixation which prevents the ski 26 from windmilling in a fall. Each recess has a sloping top bearing wall, and a pair of inclined side bearing walls, which have a different ratio of inclined angles with respect to the other recess or recesses in order to define different ratios of upward to lateral release pressure required to cause the tongue 64 to move out of engagement with the retainer plate 24. If a skier desires to change the release pressure ratio, it is merely necessary to remove the screws 66 and rotate the heel retainer plates 24 by 180° (or 90° if more than two recesses are provided), after which the screws 66 are replaced to engage the same mounting hold.

For additional details on the cant/forward lean adjustment, and the upward to lateral release ratio adjustment, reference should be made to my before identified copending application Ser. No. 338,595, filed Mar. 6, 1973, entitled "Ski Binding Apparatus", now U.S. Pat. No. 3,876,218, issued Apr. 8, 1975, the contents of which are hereby incorporated herein by reference thereto.

To provide a ski boot width adjustment, the channels 84 include a divider which forms adjacent outer and inner channels, corresponding to a wider or narrower width ski boot. Each arm 74 has an extending pin, located a sufficient distance from the end of the arm so that the arm end extends into an internal bore whenever the pin is captured in either of the inner or outer channels. This provides an inner support for the arm, distributing any forces to the sole plate which thus forms bearing surfaces on both sides of the pin.

To ensure snug engagement of the beveled tongue 64 in the recess in the heel retainer plate 24, a pair of adjustment screws 110 are located in threaded apertures at the heel end of the sole plate 32. Each screw 110 has a Teflon coated shank 111 (see FIG. 2) which extends beyond the bottom of the sole plate 32 and rests on a polished stainless steel plate 112 which is clamped to the ski 26 by the heel retainer plate 24. The screws 110 are adjusted to raise the sole plate so as to produce the snug engagement.

For further details on the width adjustment and the heel raising screws, reference should be made to my before identified copending application Ser. No. 263,295, filed June 15, 1972, entitled "Ski Binding Apparatus and Method of Mounting", now U.S. Pat. No. 3,874,685, issued Apr. 1, 1975, the contents of which are hereby incorporated herein by reference thereto.

ANTI-SHOCK ARCUATE SOCKET

Turning first to FIGS. 1–8, a first embodiment of the arcuate socket 60 and associated toe release unit 22 is shown in detail. The arcuate socket 60 is formed by an indent having an enlarged head 120 and a reduced diameter neck 122 which snugly fits within a mating bore in the integral ear 62. An internally threaded metal insert 124 (see FIG. 4) is located within a bore of the neck 122, and receives an adjustment screw 126 which extends through an elongated vertical slot 128 in the ear bracket 30. The forward facing surface 130 of the bracket 30 is ribbed and mates with a corresponding ribbed surface on the upright ear 62. To compensate for the varying thicknesses of ski boot soles, the adjustment screw 126 is loosened to allow the ear 30 to be raised and lowered within the vertical slot 128.

Figure 5:
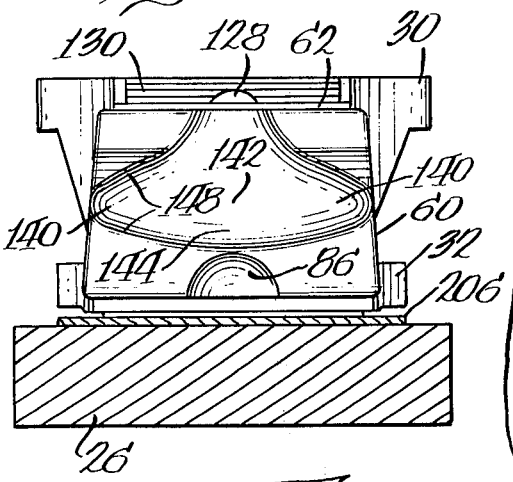
FIG. 5 is a front plan view of the arcuate socket, taken along lines 5—5 of FIG. 4.
Figure 6:
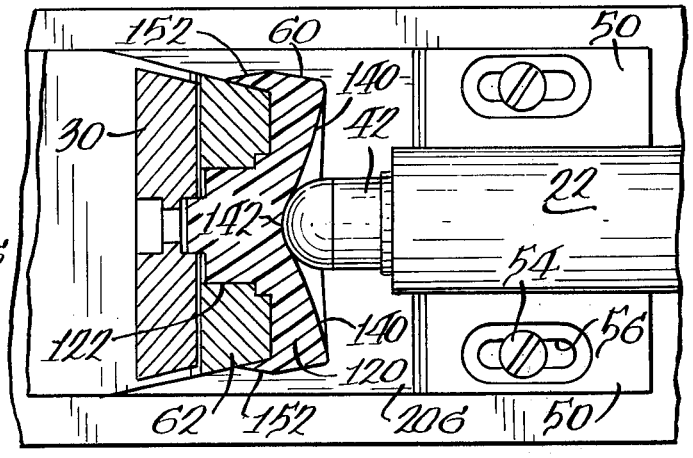
FIG. 6 is a top view, partly in section, of the toe unit and arcuate socket, taken along lines 6—6 of FIG. 4, and shows the relationship when a release force is not present.
Figure 7:
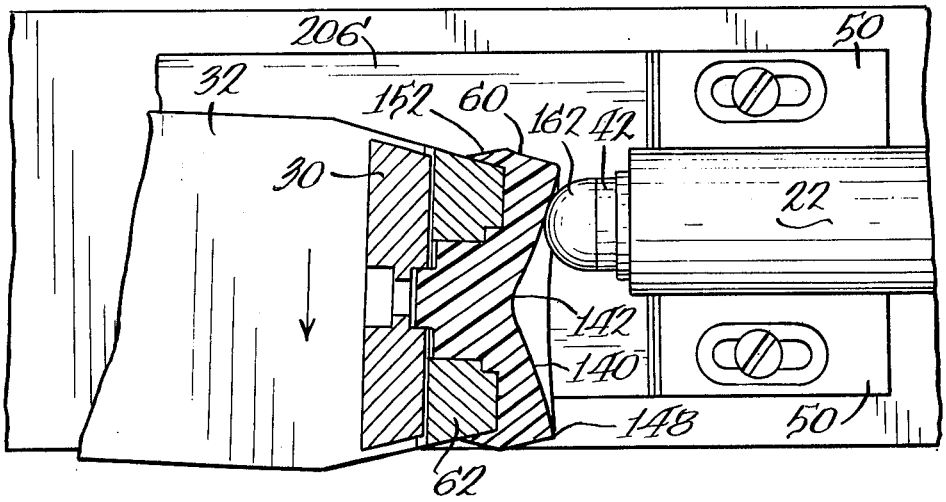
FIG. 7 is a top view, partly in section, similar to FIG. 6, and shows the relationship when a release force is present but the sole plate has not reached the release position.
Figure 8:
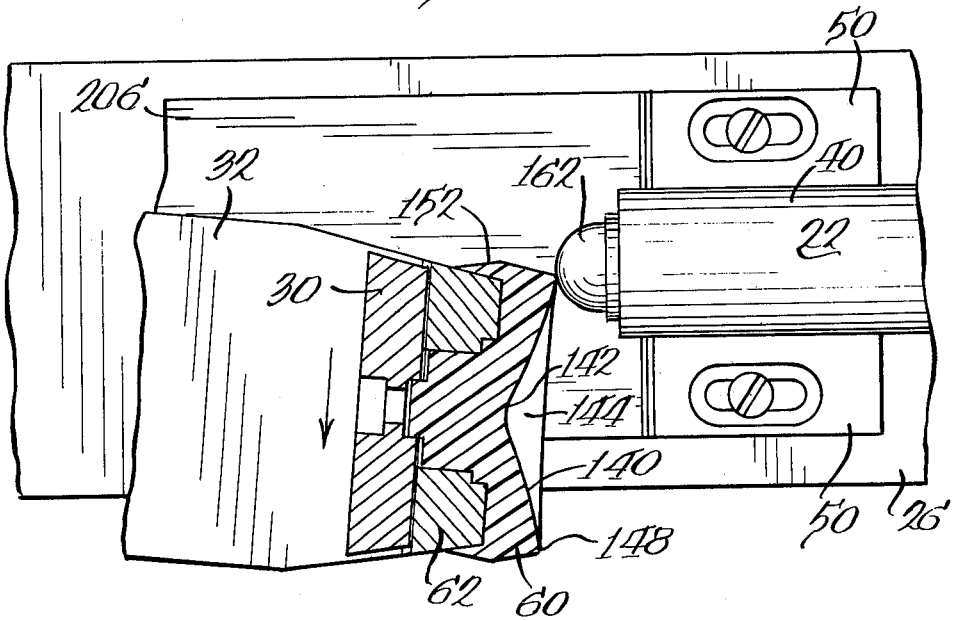
FIG. 8 is a top view, partly in section, similar to FIGS. 6 and 7, and shows the relationship when a release is present and the sole plate has traveled to the release point.

The arcuate socket 60 has a concave, nonsymmetrical recess defined by a pair of side walls 140 which extend at a sloping incline outward from a nadir 142 located on the axis of the release pin 42, and a bottom wall 144 which extends at a sloping incline outward from the nadir 142 and downward toward the ski. The sloping walls terminate in a generally eliptical shaped rim 148 which defines the limit of anti-shock travel which can return the release pin 42 to its rest or nadir position, shown in FIG. 6. The lower rim 148 of the concave socket curves upward, as seen in FIG. 5, so that contact is continuously made between the release pin and the socket even while the release pin is being retracted as the sole plate moves laterally to the side. This controlled downward pressure insures that the sole plate is maintained firmly against the ski 26 until the release point is exceeded.

The enlarged head 120 includes a pair of side flanges 152 which extend axially rearward over a portion of the upright ear 62. Thus, the indent socket 60 is of larger lateral dimensions than the lateral dimensions of the upright ear 62. The side flanges 52 also aid in release as will be explained.

Release pin 42 is formed by a tubular plastic sleeve 160 (see FIG. 4) having an end bore which receives a reduced diameter cylindrical neck 164 of a metal hemisphere end cap 162. The plastic sleeve 160 slidingly engages a plastic bearing sleeve 166 which is snugly received within a circular bore in the tubular metal housing 40. The outside diameter of the tubular sleeve 160 abuts the inside diameter of a smooth tubular cavity or bore within the metal housing 40. The sleeve 160 has an axial or longitudinal extent which is a substantial portion of the length of the interior bore, thereby forming a long bearing surface, which, in cooperation with the bearing sleeve 166, prevents motion transverse to the longitudinal axis of the release pin.

Disposed within the tubular sleeve 160 is a bias means with a high spring rate, formed by a first helical spring 170 and a smaller second helical spring 172. The pair of coaxial springs 170, 172 have their opposite ends received within a tubular end sleeve of the adjustment screw 44. Manual rotation of screw 44 changes the compressed length of the pair of pressure springs 170, 172 thereby varying the pressure setting at which the release pin head 162 will axially retract sufficiently to release the sole plate. The lock sleeve 46 which surrounds the adjustment screw 44 prevents inadvertent rotation of the adjustment screw 44. By use of a pair of springs 170, 172, the release pressure can be increased to that required for a competition-type ski binding.

To maximize the anti-shock characteristics while still retaining the desired safety characteristics, the dimensions of the concave socket and the release pin are chosen as follows. For a competition-type ski binding, the concave socket 60 was constructed to have side walls 140 with a lateral extent between the side edges of rim 148 of 1.75 inches. The actual length of the path for the hemisphere end 162 is of course longer, since the walls 140 have both a lateral and a radial extent. The vertical extent of the bottom wall 144 from the nadir 142 to the bottom edge of the rim 148 was 0.25 inches. Since the binding can release laterally to either side, the lateral release distance was one-half of 1.75 inches, or 0.875 inches, producing a ratio of 3.5 to 1 for the lateral side release distance divided by the vertical release distance of the concave socket. The side wall 140 is selected to have a maximum slope in the vicinity of the nadir 142, and then a flat slope out to the rim 148. For a particular setting of the adjustment screw 44, a release pressure of 40 to 45 pounds will be required to initiate a one-eighth inch movement of the sole plate. At 50 pounds of release pressure, the sole plate 32 will have moved beyond the intermediate position shown in FIG. 7 to the release position shown in FIG. 8. As the axis of the release pin passes the rim 148, the metal head 162 rides against the flange 152 and kicks the sole plate 32 out of engagement with the release pin. A large force is produced against the side flange 152 as the metal end 162 passes the rim 148 and axially extends. The arcuate socket, when extending beyond the metal upright ear 62, must therefore have a configuration which will resist these forces generated during a release.

The diameter of the hemisphere end 162 was 0.5625 inches, and the diameter of the slightly larger plastic sleeve 42 was 0.625 inches. While the metal head 162 is illustrated as being approximately a hemisphere, it will be appreciated that any spherical segment can be utilized, providing it is of sufficient extent to contact the side and bottom walls of the concave socket during release movement. Since the lateral width of the active part of the concave socket was 1.75 inches, and the diameter of the spherical segment 162 was 0.5625 inches, the ratio of the lateral extent of the arcuate socket with respect to the lateral extent of the release pin was 3.1 to 1. These high ratios have been found to produce a marked increase in the desirable amount of anti-shock travel, while retaining the sole plate 32 firmly against the ski 26.

The maximum lateral extent of the active portion of the arcuate socket can be determined in accordance with the following considerations. When the sole plate is located at the release position, FIG. 8, the center line of the sole plate 32 preferably should not extend over the ski 26. Beyond this position, the sole plate 32 is in an unstable region where it may wobble, and thus ski steerage or edge control is reduced. At the point where edge control cannot be positively retained, the sole plate preferably should be released. This maximum is also influenced by the permissible forces which should be allowed to be created on the skier's leg. Too great a distance of travel can allow the ski 26 to be at such a large angle, for some falls, that the forces created will injure the skier's knee, even though the forces to break a leg have not been exceeded. Thus, the amount of twisting that the skier's leg may receive during a fall can be reduced by not allowing the anti-shock travel distance to be so great as to create the possibility of twisting the skier's leg to the point of knee injury. Considering all these factors, the arcuate socket shown in FIGS. 1–8 has been found advantageous for competition-type skiers.

Figure 9:
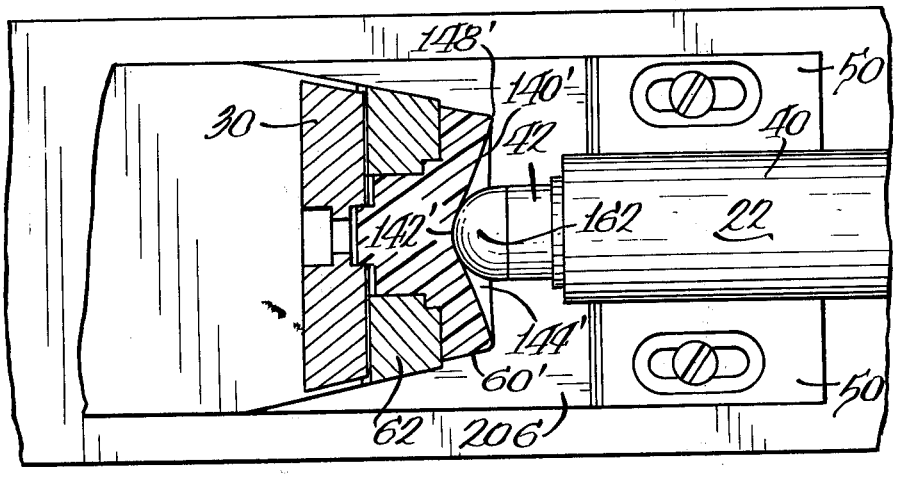
FIG. 9 is a top view, partly in section, similar to FIG. 6, showing a modified arcuate socket.

For recreational skiers, the large anti-shock travel produced by the arcuate socket of FIGS. 1–8 is not so necessary, considering that increased anti-shock travel can also allow increased twisting of the leg. A second embodiment of the arcuate socket, for a recreational skier, which still retains improved anti-shock characteristics over the prior art, is shown in FIG. 9. The same reference numerals have been used for the socket, followed by prime (′). The dimensions of the release pin spherical segment 162 are the same as in the prior embodiment. The lateral extent of the pair of side walls 140′ is 1.5 inches. The vertical extent of bottom wall 144′ is 0.25 inches, as in the prior embodiment. Since the lateral extent of release, for any one side, is 0.75 inches, the ratio of the lateral side release distance to the upward release distance is 3 to 1. Considered alternatively, since the lateral width across the side edges of the rim 148′ is 1.5 inches, and the lateral extent of the spherical segment 162 is .5635 inches, the ratio of the lateral extent of the arcuate socket with respect to the lateral extent of the release pin is 2.7 to 1.

The above embodiments should be contrasted with a typical prior art socket. Such a typical socket would have a lateral extent between the edges of the rim of 0.75 inches, or about one-half of the extent for the arcuate socket of FIG. 9. The vertical extent of the bottom wall would be about 0.25 inches. Thus, the ratio of the lateral side release distance to the upward release distance is 1.5 to 1. The release pin would have approximately same dimensions as in the present application. Considered alternatively, therefore, the ratio of the total effective lateral width of the socket with respect to the total lateral width of the spherical release pin segment is 1.3 to 1.

The illustrated arcuate sockets are replaceable, and can be removed by removal of the screw 126, allowing the socket to be pulled out of the capturing bore in the upright ear 62. A ski shop or the skier can be supplied with different arcuate sockets, such as the recreational versions shown in FIG. 9 and the competition versions shown in the remaining figures. This allows the ski binding to be adapted to the ability of different skiers, without requiring different models. In the case of a recreational skier, the center helical spring 172 can be removed, so that the range of release pressures are more suitable for a skier of lesser ability.

PIVOT POINT CONSTRUCTION

To reduce friction and establish a forward pivot point for certain types of release, a Teflon bar 200, see FIGS. 1 and 2, is swaged in a holder extension 202 of the sole plate 32. The location of the anti-friction bar 200 is preferably under the ball of the skier's foot, which coincides with one axis of forces present during a fall. For a sole plate 32 which has a longitudinal dimension of 11.75 inches from the rear edge of tongue 64 to the front edge of the ear 62, the bar 200 would be located in the range of from 2 inches to 5 inches behind the front edge of the plate 32 (i.e., the structure of FIG. 2 without the arcuate socket 60). Considering the entire length of the sole plate 32, the bar 200 is thus preferably located from 17 to 43 percent of the distance from the front of the sole plate.

During a forward lean type release, the sole plate 32 will pivot about the bar 200 as the tongue 64 rides out of the rear recess. This release requires movement of the bar 200 over the ski. To reduce friction, a polished stainless steel plate 206 is located thereunder. The plate 206 is clamped to the ski 26 by screws 57 (see FIG. 3) which attach the lower plate 52 to the ski.

The location of the pivot bar 200 in combination with the rear height adjust screws 110 serves to create a raised platform which will release with minimum stress on the skier's leg and knee. It will be appreciated that during a backward type fall, the pivot point is at the shanks 111, rather than at the pivot bar 200. The thickness of the sole plate 32 must be sufficient so that the weight and forces created cannot warp or otherwise change the plane of the planar sole plate. Near the heel portion of the sole plate, the thickness may be increased to accommodate the longitudinal adjustment apertures 76, while not reducing the rigidity of the sole plate.

I claim:

1. A ski binding for releasably securing a ski boot to a ski, comprising:

sole plate means securable to the ski boot and having an upright member mounting a replaceable arcuate socket including mounting means for replaceably securing the socket to the member and a recess surface with a side wall extending at a sloping incline outward from a nadir to a rim and a bottom wall extending at a sloping incline outward from the nadir to the rim, the lateral extent of the side wall being more than twice the vertical extent of the bottom wall, and the rim surrounding the side wall and the bottom wall has a generally eliptical shape with the rim in the vicinity of the bottom wall sloping vertically upward towards the side wall, a release unit mountable on the ski including a release pin biased into mating engagement with the nadir of the release surface so that movement of the sole plate means due to an external release pressure forces the release pin to relatively move along the walls until reaching the rim, the sloping incline of walls forcing return relative movement of the release pin to the nadir when the external release pressure is terminated and the release pin has not relatively moved beyond the rim, and the shape of the rim maintaining contact of the release pin with the bottom wall at all times until the release pin relatively moves beyond the rim.

2. The ski binding of claim 1 wherein the release surface has a pair of side walls each extending with a sloping incline laterally away from the nadir, each side wall having a lateral extent which is greater than two times the vertical extent of the bottom wall.

3. The ski binding of claim 1 wherein the release unit includes confining means for axially restraining the release pin for movement solely in an axial direction which extends through the nadir of the socket in the absence of an external release force.

4. The ski binding of claim 1 including a second release unit mountable on the ski for releasably securing the end of the sole plate means opposite the arcuate socket, an anti-friction bar located on the bottom of the sole plate means and forming a pivot point for allowing movement of the sole plate means out of engagement with one of the release units, the anti-friction bar being located in the vicinity of the ball of the skier's foot when secured to the sole plate means.

5. The ski binding of claim 1 wherein the side wall has a lateral extent equal to or more than three times the vertical extent of the bottom wall.

6. A ski binding for releasably securing a ski boot to a ski, comprising:

sole plate means releasably securable to the ski boot and having an upright ear extending generally vertically upward, means attached to the upright ear for securing an extending sole of the ski boot to the sole plate means, and an arcuate socket with a side wall extending at a sloping incline outward from a nadir to a rim and a bottom wall extending at a sloping incline outward from the nadir to the rim, the lateral extent of the side wall being more than twice the vertical extent of the bottom wall, the arcuate socket extending laterally beyond the upright ear to increase the anti-shock movement of the binding, and a release unit mountable on the ski including a release pin biased into mating engagement with the nadir of the arcuate socket so that movement of the sole plate means due to an external release pressure forces the release pin to relatively move along the walls until reaching the rim, the sloping incline of the walls forcing return relative movement of the release pin to the nadir when the external release pressure is terminated and the release pin has not relatively moved beyond the rim.

7. The ski binding of claim 6 wherein the socket includes a pair of side flanges which extend against the sides of the upright ear.

8. A ski binding for releasably securing a ski boot to a ski, comprising:

a release unit mountable on the ski including a release pin having a segmentally spherical end, means for confining the release pin for movement solely in an axial direction coaxial with the ski, spring means for biasing the release pin, and sole plate means releasably securable to the ski boot including a replaceable arcuate socket, mounting means for replaceably securing the socket to the sole plate means, the socket having a recess surface locatable in mating engagement with the segmentally spherical end of the release pin, the recess surface having side walls extending laterally at an incline outward from the point of engagement of the segmentally spherical end with the recess surface to a rim and a bottom wall extending at an incline outward from the point of engagement to the rim, the lateral extent of the side walls being more than twice the lateral extent of the segmentally spherical end, the slope of the side walls returning the sole plate means into mating engagement with the release pin when an external release force is terminated, and the rim surrounding the side walls and the bottom wall has an arcuate shape with the rim in the vicinity of the bottom wall sloping vertically upward towards the side walls to maintain contact of the segmentally spherical end with the bottom wall at all times until the segmentally spherical end relatively moves beyond the rim.

9. The ski binding of claim 8 wherein the sole plate means includes an upright member which mounts the arcuate socket in a direction facing the release unit and means attached to the upright member for securing an extending sole of the ski boot to the sole plate means, the arcuate socket extending laterally beyond the upright member to increase the anti-shock travel of the ski binding.

10. The ski binding of claim 8 wherein the lateral extent of the side walls is greater than three times the lateral extent of the segmentally spherical end.

11. The ski binding of claim 8 wherein the release unit includes base means fixedly securable to the ski, an assembly including the release pin and the spring means which is axially movable with respect to the base means for axially moving the release pin to allow the segmentally spherical end to engage the arcuate socket.

12. The ski binding of claim 8 wherein a second release unit is mountable on the ski for releasably securing the sole plate means opposite the arcuate socket, an anti-friction bar is located on the bottom of the sole plate means and forms a pivot point for allowing movement of the sole plate means out of engagement with one of the release units, the anti-friction bar being located in the region under the vicinity of the ball of the skier's foot when secured to the sole plate means.

13. A ski binding for releasably securing a ski boot to a ski, comprising:

a release unit including a lower plate fixedly securable to the ski and having an upper ribbed surface, an assembly detachable from the lower plate and including a release pin having a segmentally spherical end, means for confining the release pin for movement solely in an axial direction coaxial with the ski, spring means for biasing the release pin, and a lower ribbed surface which mates with the upper ribbed surface to provide a plurality of spaced detent positions for the assembly relative to the lower plate, and means extending between the assembly and the lower plate to clamp the ribbed surfaces into engagement at a selected detent position, and sole plate means releasably securable to the ski boot including an upright member mounting a replaceable arcuate socket, mounting means for replaceably securing the socket to the member, the socket having a recess surface locatable in mating engagement with the segmentally spherical end of the release pin by axially moving the assembly to the selected detent position, the recess surface having side walls extending laterally at an incline outward from the point of engagement of the segmentally spherical end with the recess surface, the lateral extent of the side walls being more than twice the lateral extent of the segmentally spherical end, the slope of the side walls returning the sole plate means into mating engagement with the release pin when an external release force is terminated.

14. A ski binding for releasably securing a ski boot to a ski, comprising:

a pair of release units each mountable to the ski at spaced locations, sole plate means releasably securable to the ski boot and locatable in mating engagement with the pair of release units to releasably secure the sole plate means to the ski, including an anti-friction bar on the bottom of the sole plate means and located nearest one of the release units, the anti-friction bar extending towards the ski to form a pivot point which allows movement of the sole plate means out of engagement with the release units, the anti-friction bar being located in the region under the vicinity of the ball of the skier's foot when secured to the sole plate means, and a bore is formed in the sole plate means nearest the other of the release units, adjustment means movably mounted within the bore to extend towards the ski and vary the height of the sole plate means above the ski, the adjustment means forming a second pivot point spaced from the first named pivot point.

15. The ski binding of claim 14 including a second bore formed in the sole plate means in the vicinity of the other release unit, second adjustment means movably mounted within the second bore to contact the ski and vary the height of the sole plate means above the ski, the first named and second adjustment means being located along an axis parallel with a longitudinal axis of the anti-friction bar.

16. A ski binding for releasably securing a ski boot to a ski, comprising:

a pair of release units each mountable to the ski at spaced locations, one of the release units including screw means for securing the one release unit to the ski, sole plate means releasably securable to the ski boot and locatable in mating engagement with the pair of release units to releasably secure the sole plate means to the ski, including an anti-friction bar on the bottom of the sole plate means and extending towards the ski to form a pivot point which allows movement of the sole plate means out of engagement with the release units, the anti-friction bar being located in the region under the vicinity of the ball of the skier's foot when secured to the sole plate means, and an anti-friction plate locatable between the ski and the bar and extending from the one of the release units to under the anti-friction bar, the screw means of the one release unit extending through apertures in the plate to fixedly secure the plate to the ski.

* * * * *